US008549979B2

(12) United States Patent
Spransy

(10) Patent No.: US 8,549,979 B2
(45) Date of Patent: Oct. 8, 2013

(54) COLLAPSIBLE, MOBILE SPECIAL OPERATIONS BUNKER

(75) Inventor: Peter J. Spransy, Salt Lake City, UT (US)

(73) Assignee: DAW Technologies, Inc., Salt Lake City, UT (US)

( * ) Notice: Subject to any disclaimer, the term of this patent is extended or adjusted under 35 U.S.C. 154(b) by 188 days.

(21) Appl. No.: 13/164,964

(22) Filed: Jun. 21, 2011

(65) Prior Publication Data

US 2012/0174768 A1 Jul. 12, 2012

Related U.S. Application Data

(60) Provisional application No. 61/356,934, filed on Jun. 21, 2010.

(51) Int. Cl.
*F41H 5/14* (2006.01)
*B23P 19/00* (2006.01)

(52) U.S. Cl.
USPC ..... 89/36.09; 89/36.07; 89/929

(58) Field of Classification Search
USPC ..... 89/36.07–36.09; 29/401.1
See application file for complete search history.

(56) References Cited

U.S. PATENT DOCUMENTS

| | | | | |
|---|---|---|---|---|
| 6,907,811 | B2 | 6/2005 | White | |
| 7,849,781 | B2 | 12/2010 | White | |
| 7,891,283 | B2 | 2/2011 | Kleniatis et al. | |
| 2003/0150186 | A1 * | 8/2003 | Spransy | 52/578 |
| 2003/0154672 | A1 * | 8/2003 | Spransy et al. | 52/238.1 |
| 2007/0175132 | A1 * | 8/2007 | Spransy et al. | 52/263 |
| 2007/0193218 | A1 * | 8/2007 | Spransy | 52/782.1 |

* cited by examiner

*Primary Examiner* — Michael David
(74) *Attorney, Agent, or Firm* — Madson IP, P.C.

(57) ABSTRACT

A mobile ballistic bunker has a deployment mode and a storage mode. The ballistic bunker has a frame for holding ballistic panels in a vertical disposition for deployment and a horizontal disposition for storage. At least one of the ballistic panels is a vision panel made of a ballistic glass or other see-through ballistic material. The frame is supported by wheels that permit movement of the bunker over rough terrain. The wheels can be retractable to enhance the low-footprint of the bunker for storage.

17 Claims, 14 Drawing Sheets

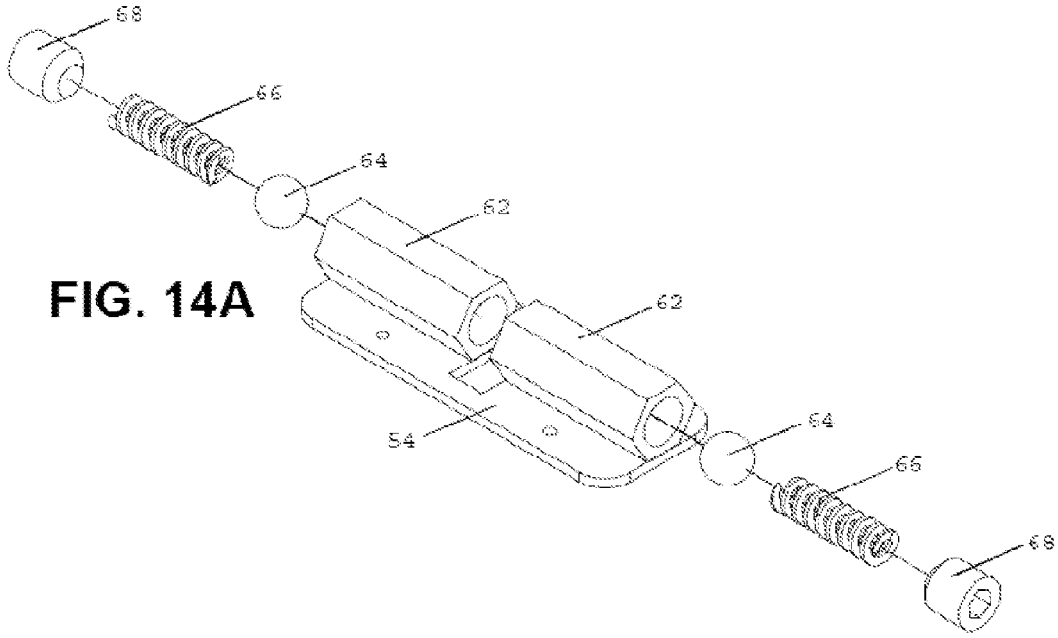
FIG. 14A
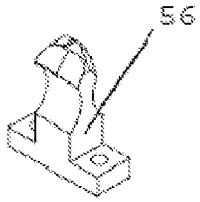
FIG. 14B
FIG. 15
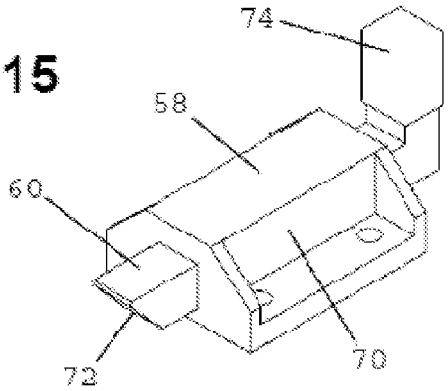

COLLAPSIBLE, MOBILE SPECIAL OPERATIONS BUNKER

RELATED APPLICATION

This application claims the benefit of U.S. Provisional Application No. 61/356,934 filed Jul. 21, 2010 and entitled Collapsible, Mobile Special Operations Bunker, and is incorporated herein by this reference.

BACKGROUND OF THE INVENTION

1. Field of the Invention

The present invention relates generally to portable ballistic barriers. More specifically, the embodiments of the present invention relate to deployable, mobile bunkers that are collapsible for easy storage and transport and may be rapidly deployed when needed.

2. The Relevant Technology

Law enforcement agencies, particularly SWAT teams, are often called upon to confront armed and dangerous individuals. It is not uncommon for these agencies to be facing 30-06 rifle rounds since these are common in hunting. Additionally, criminals have been known to purchase .223 green-tip penetrator rounds which are available for purchase to civilians.

Although it is standard practice for law enforcement to wear body armor, the body armor presently available is heavy and typically only rated for handguns. For example, a National Institute of Justice (NIJ) level IIIA vest's maximum rating is for a limited number of shots from a 44 magnum handgun. Personal body armor material is bulky and heavy, vests weigh approximately 10 pounds. The shape and size of the armor must not interfere with the officer's agility therefore vests are designed to be as small as practical. Consequently, they only cover the vital areas of the body. In general terms, a "bulletproof" vest or other armor will protect personnel from the vast majority of handgun threats. But, there is always a tradeoff between protection, wear-ability and budget constraints. It should be understood that body armor can be defeated by rifle rounds, unusually high velocity pistol ammunition, pistol ammunition fired from a rifle barrel, armor piercing ammunition, sharp-edged or pointed instruments (e.g., knives, ice-picks, arrows, etc.), and/or other unusual ammunition and/or situations.

Also, at some angles, projectiles can slide, or deflect off the edges of armor, or ricochet. Furthermore, projectiles that are successfully stopped by armor will always produce some level of injury, resulting in severe bruising, broken bones, and possibly serious internal injury, even death. Soft body armor defeats most pistol and shotgun projectiles, but no vest makes personnel invulnerable to all threats.

Further, the head is much more susceptible to blunt trauma than the body. Any impact of a bullet on a helmet will cause injury and can cause death. The odds of serious injury are reduced with head protection, but, just as with any armor, no guarantee of invulnerability can be made.

For additional protection (in addition to wearing personal body armor) personal shields may be employed. Personal shields are heavy, so they are designed to only cover the vital areas of the body. Shields provide an additional layer of protection, however, most shields are also only rated for handguns and they hinder the ability of the officer to travel long distances due to their weight (approximately 30 pounds). The ability to manipulate a weapon is also severely limited since at least one of the officer's hands is occupied carrying the shield.

The level of protection required for each confrontation can vary widely. It is not uncommon for an agency to consider the 30-06 and the .223 green-tip penetrator rounds as their most severe threat. Furthermore, to permit adequate observation without unnecessarily exposing personnel, such personnel typically needs to be positioned within a distance of about 30 yards. These requirements have established a baseline of performance that is required if adequate protection for personnel is to be provided.

Currently, there are two rating systems for ballistic protection: 1) Underwriters' laboratory (UL), and 2) The National Institute of Justice, (NIJ). The rating systems are not consistent between the two entities and they do not precisely identify the rating for a 30-06 and/or a .223 green-tip penetrator round. To properly rate a ballistic panel for these particular rounds, it is necessary to have a ballistic panel tested at an approved independent test laboratory for: 1) each specific ammunition type, and 2) the specific target distance.

It would be an advance in the art to provide meaningful protection against 30-06 and/or .223 green-tip penetrator rounds that does not need to be carried by personnel. Law enforcement agencies would find such protection to be quite attractive. Although the following description focuses primarily on the requirements of law enforcement agencies, it should be evident and it has been considered that this invention could be used by various agencies such as, but not limited to: military, secret service, homeland security, etc.

It would also be an advance in the art to provide a collapsible, mobile bunker low-footprint that can easily be stored in the trunk of a car, the rear of an SUV, or in an armored personnel carrier (APC) and that can be readily deployed when needed.

BRIEF SUMMARY OF THE INVENTION

The present embodiments constitute a collapsible, mobile ballistic bunker. The mobile ballistic bunker is a collapsible frame on wheels. In one embodiment, the frame permits the vertical stacking of three ballistic panels that act as a full-body shield or wall. Preferably, the frame is made of a lightweight aluminum and has side channels for receiving ballistic panels in nesting engagement. Each of the ballistic panels is removably insertable into the side channels of the frame and overlaps with the adjacent panel so that ballistic integrity is maintained at the joints. Because the ballistic panels are removably insertable into the frame, the panels can be interchanged if damaged or if a higher or lower ballistic-rated panel is desired. Also, the ballistic panels can be disposed in layers such that an air gap can be provided between layers of ballistic panels. The topmost panel is a vision panel made of ballistic glass. In some embodiments, at least one ballistic panel has integrated handholds for removal of the ballistic panel from an assembled mobile ballistic bunker to be used as a personal ballistic shield. In some embodiments, the ballistic panels weigh less than 50 pounds each. The ballistic panels may be encased in polyurea.

In some embodiments, the mobile ballistic bunker includes a movement assembly for supporting the frame. The movement assembly may comprise any of a number of types of wheels, runners, or rubber track systems, however, caster-type wheels with large run-flat tires that permit the movement of the bunker over rough terrain are preferred. In some embodiments, the wheels rotate 360 degrees and can be locked into an orientation for front to rear or lateral motion.

In a preferred embodiment, the movement assembly has retractable caster-type wheels that are capable of pivoting into a refracted, nesting position for low-footprint storage.

The term "low-footprint" as used herein means that the height profile and the girth profile of the overall bunker is minimized to a compact assembly to save storage space and to facilitate transport of the bunker.

Additionally, an apron of ballistic material may be connected to the lowermost panel to extend to the ground. This ballistic apron will reduce the threat of "skip-rounds."

After being deployed, the mobile ballistic bunker may be collapsed into a storage mode for storage and easy transport. The vision panel is removed from the side channels of the frame. Slide brackets along each side of the frame are moved to permit the ballistic panels to hinge where they overlap so that the wall formed by the panels can be folded in half. With the other panels still positioned between the side channels, spring-lock pins are released from each side of the frame permitting the vertical panels to be rotated to a horizontal disposition. The vision panel can then be nested on top of the folded panels and secured for storage. A Velcro strap can be used to secure the vision panel in its nested disposition.

In some embodiments, the frame is comprised of a plurality of frame sections with side channels and the frame sections/side channels abut end to end forming joints. One set of abutting frame sections is disposed opposite another set of abutting frame sections to define an area into which ballistic panels can be removably inserted into layers of ballistic panels. The opposing side channel sets may be configured to provide for an air gap between layers of ballistic panels. Also the configuration of the layered ballistic panels is such that vertically adjacent ballistic panels overlap at the joint so that ballistic integrity is maintained at the joint.

The embodiments of the present mobile, ballistic bunker invention provide ballistic protection by using interchangeable ballistic panels rated for rifle or handgun depending upon the threat presented. Also, due to the ballistic bunker's rolling mobility, it does not need to be carried into position. Rather, the ballistic bunker can be fully deployed at a safe location remote from the desired position and then rolled into position providing ballistic protection during that movement. Once in position, it is free-standing thereby freeing up both hands of the personnel. Further, the single-wide embodiment can pass through a 3-foot doorway without exposing personnel or compromising its ballistic integrity.

For situations requiring broad ballistic protection, a double-wide embodiment of the mobile, ballistic bunker can be used. Although, for brevity of disclosure, the double-wide embodiment is not shown in the drawings, a person of skill in the art will readily understand how to make and use a double-wide embodiment from the disclosure herein.

The embodiments of this invention have been developed in response to the present state of the art, and in particular, in response to the problems and needs in the art that have not yet been fully solved by currently available body armor and shields.

These and other features of the present invention will become more fully apparent from the following description, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 14A is an exploded perspective view of a latch assembly;

FIG. 14B is a perspective view of a latch strike for engaging a latch assembly;

FIG. 15 is a perspective view of a spring-loaded slide bolt;

FIG. 16A is a top view; FIG. 16B is a front view; and FIG. 16C is a side view; FIG. 17A is a perspective view; FIG. 17B is a side view; and FIG. 17C is a top view.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Figure 1:
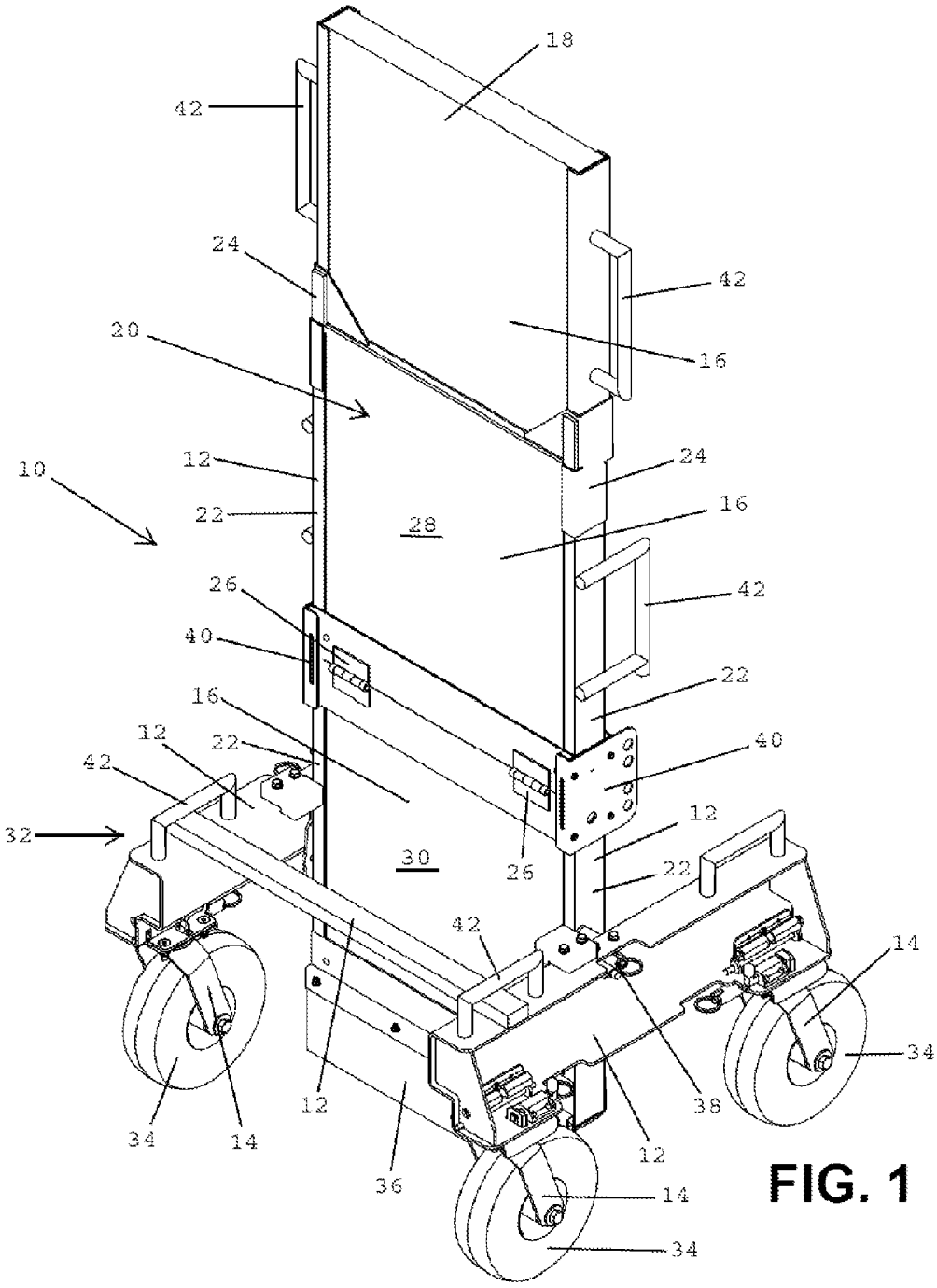
FIG. 1 is a front perspective view of a fully-assembled mobile ballistic bunker of a preferred embodiment ready for deployment.

FIG. 1 is a perspective view of a fully-assembled mobile ballistic bunker ready for deployment. The ballistic bunker 10 has a frame 12 supported by caster-type wheels 14 and ballistic panels 16. As shown, the topmost panel 16 is a vision panel 18 made of a ballistic glass. However, it should be understood that the ballistic bunker 10 may have no vision panel 18 or the vision panel 18 may optionally be a ballistic panel with a small window of ballistic glass or a gun port. The ballistic panels 16 alone or together with the vision panel 18 are positioned generally vertical to form a full-body shield or wall 20.

Figure 3:
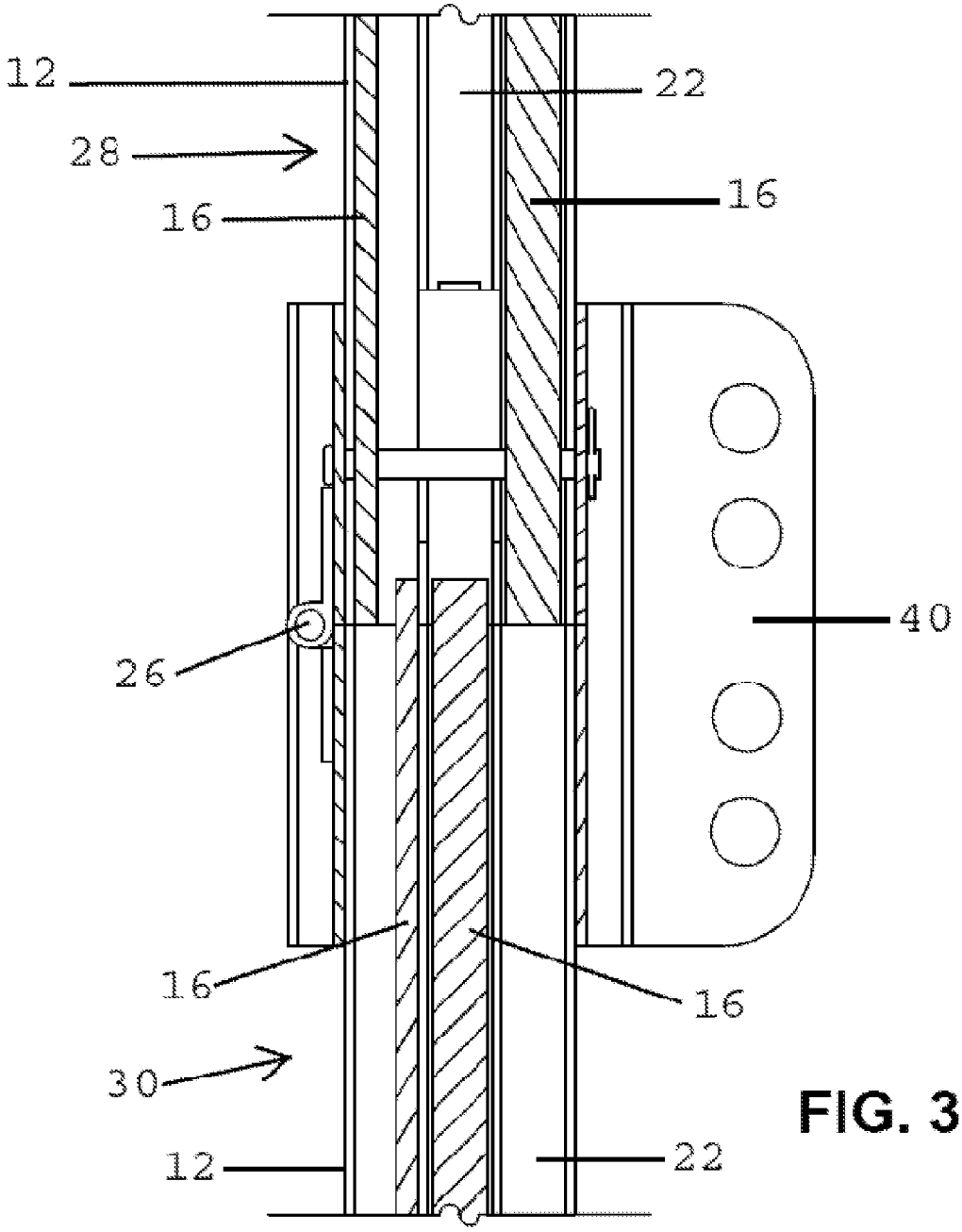
FIG. 3 is a partial cross-sectional side view of the overlapping panels of the ballistic bunker.
Figure 4:
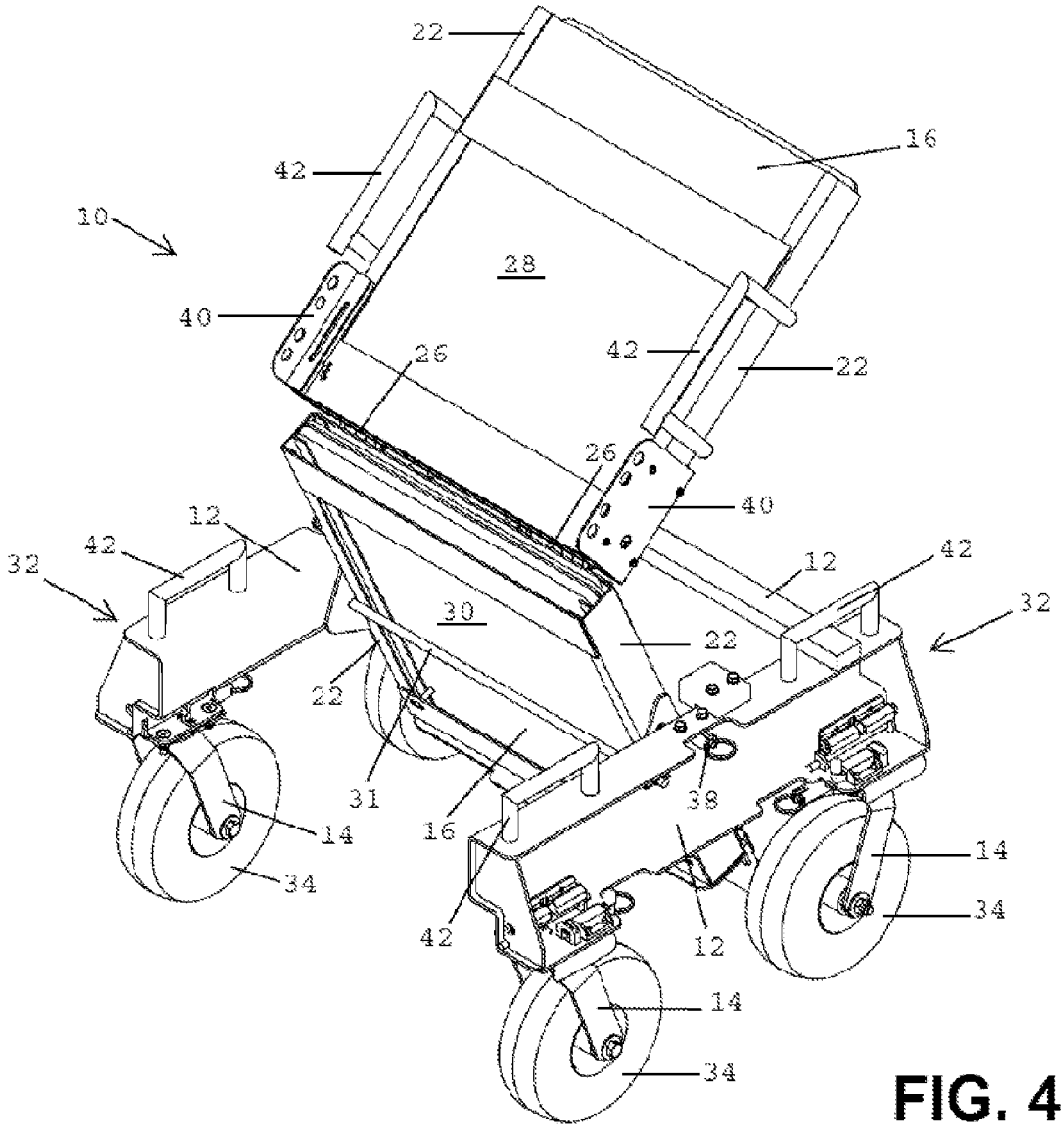
FIG. 4 is a perspective view showing the middle ballistic panel being rotated from the lowermost ballistic panel to reveal the overlapping relationship of the ballistic panels.

Preferably, the frame 12 is made of a lightweight aluminum and has side channels 22 for receiving ballistic panels 16 in nesting engagement. The side channels 22 hold the panels 16 in the generally vertical disposition to form the wall 20. Each of the ballistic panels 16 is removably insertable into the side channels 22 of the frame 12 and overlaps with the vertically adjacent panel 16 so that ballistic integrity is maintained at the joints. A portion of the frontal ballistic panels 16 extends above the abutting horizontal joint between vision panel 18 and its adjacent ballistic panel 16 so that it overlaps with the vision panel 18. FIGS. 3 and 4 show how adjacent panels 16 may overlap to maintain ballistic integrity at the joints. Because the ballistic panels 16 are removably insertable into the frame 12, the panels 16 can be interchanged if damaged or if a higher or lower ballistic-rated panel 16 is desired.

Figure 2:
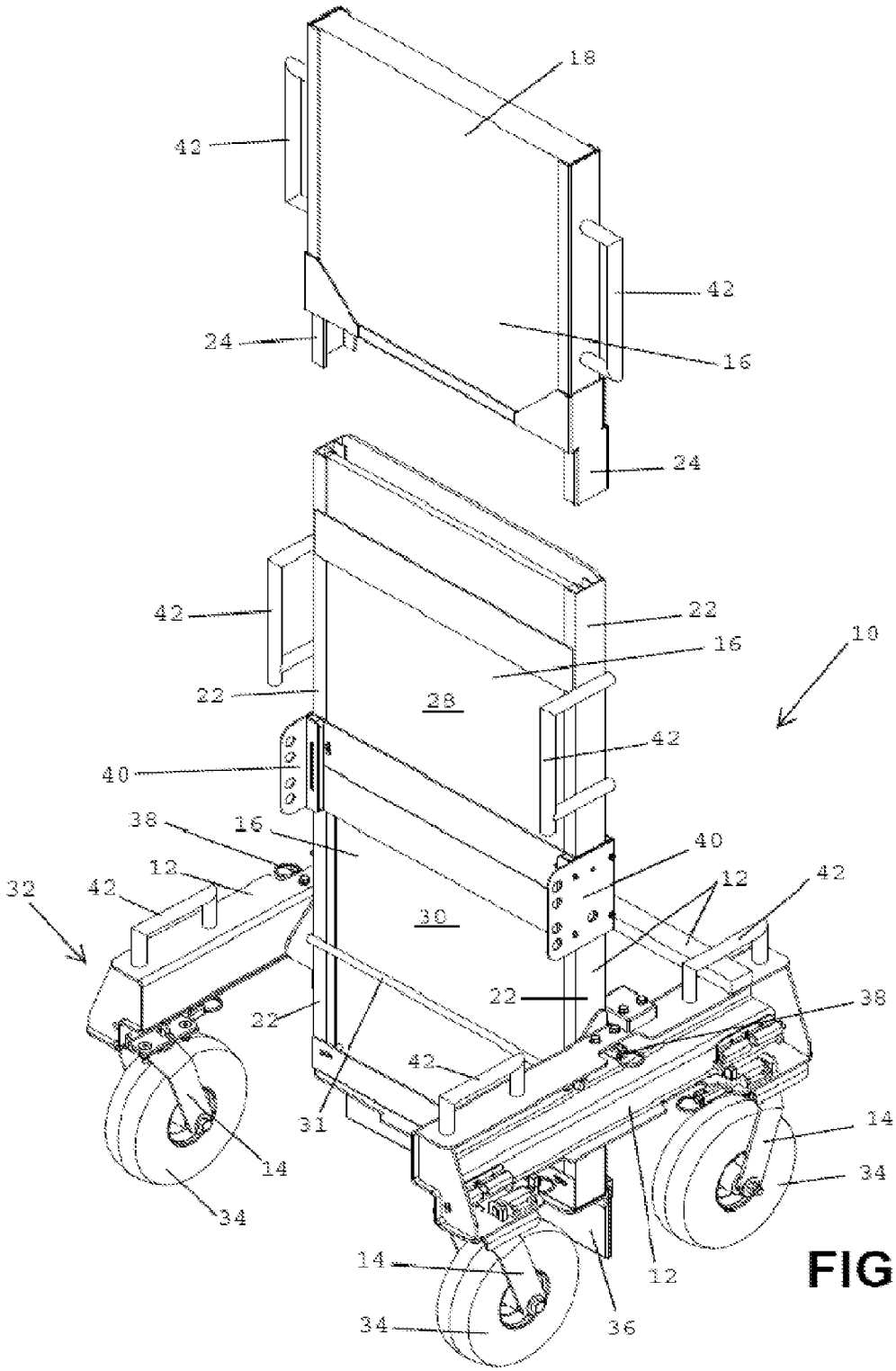
FIG. 2 is a rear perspective view of the ballistic bunker of FIG. 1 with the vision panel removed.
Figure 5:
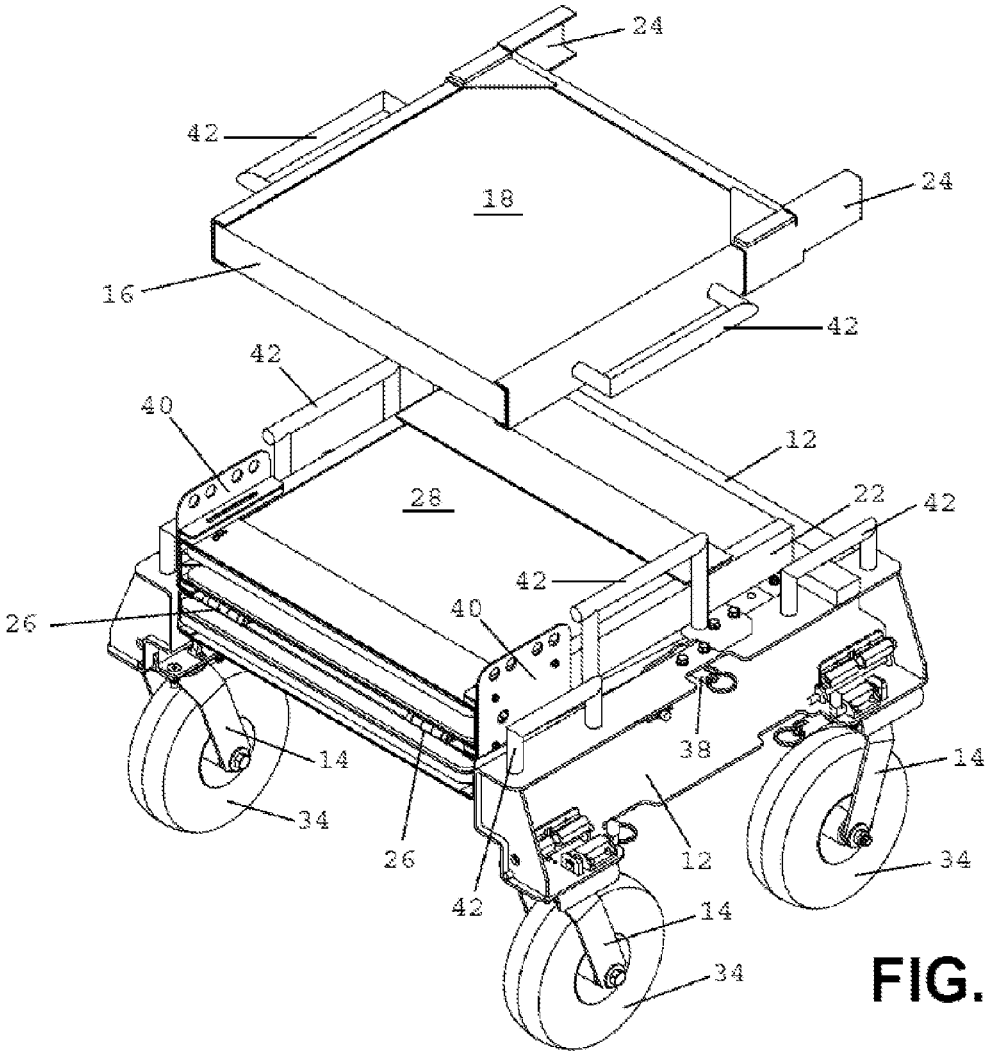
FIG. 5 is a perspective view of the partially-collapsed mobile ballistic bunker showing the vision panel before positioning for storage.
Figure 6:
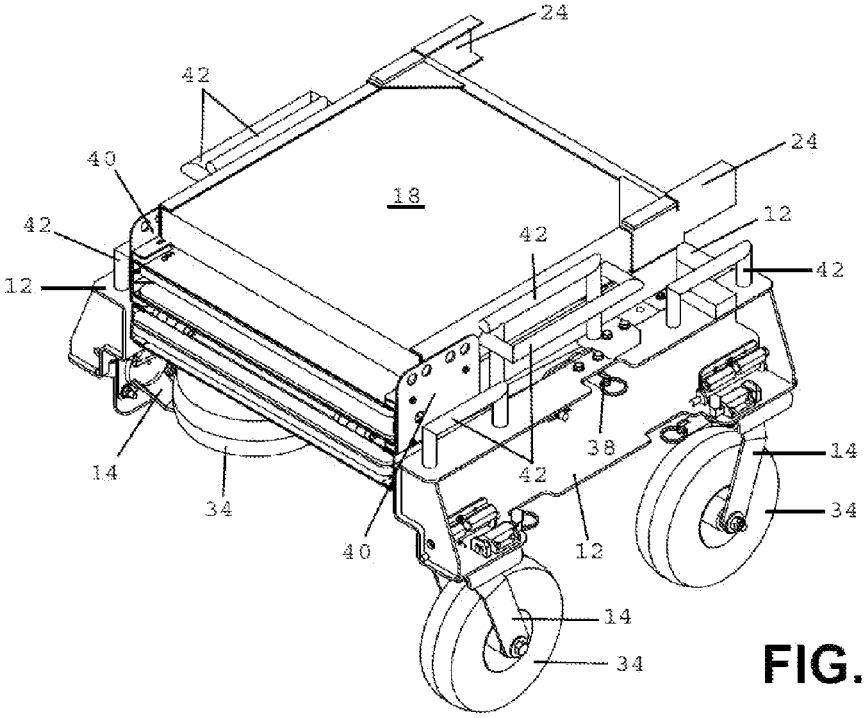
FIG. 6 is a perspective view of the partially-collapsed mobile ballistic bunker with the vision panel positioned for storage and the wheels on one side refracted for storage.
Figure 7:
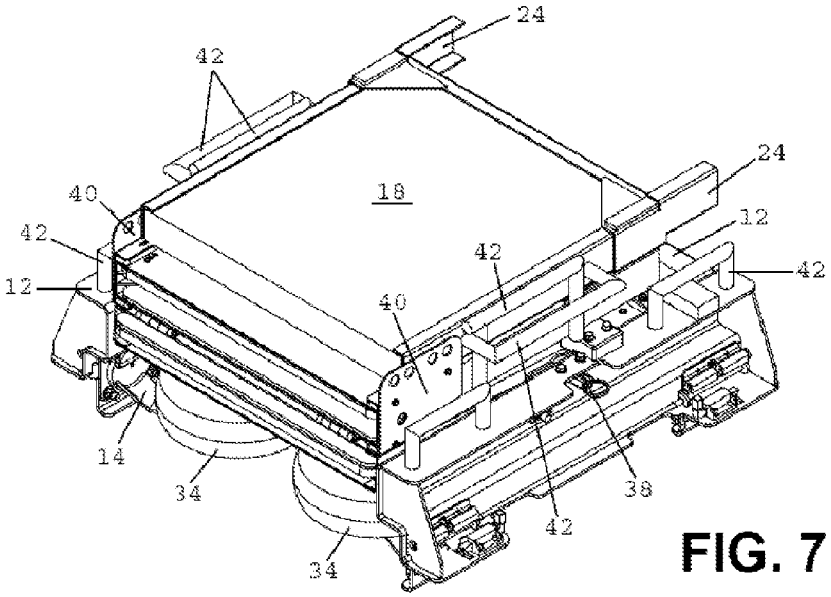
FIG. 7 is a perspective view of the fully-collapsed mobile ballistic bunker in the storage mode.
Figure 8:
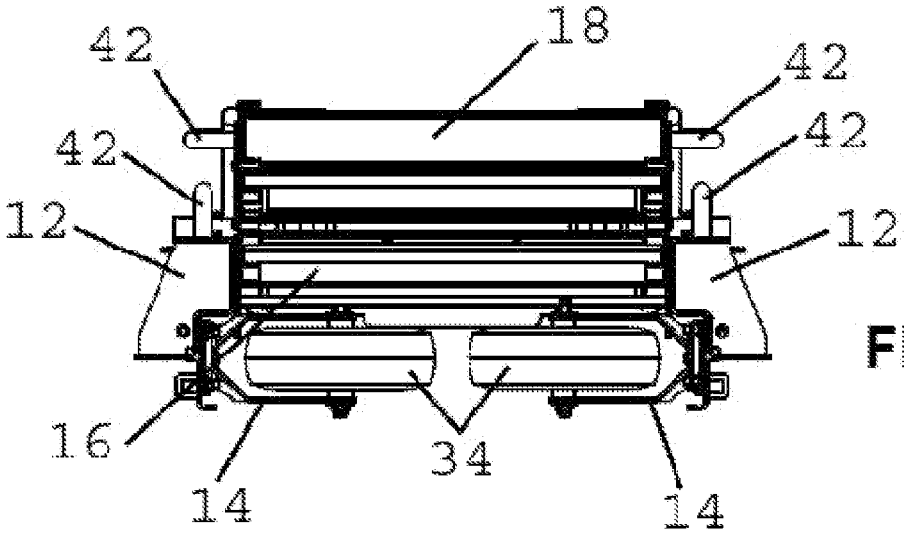
FIG. 8 is a side elevation view of the fully-collapsed mobile ballistic bunker positioned for horizontal storage and showing the retracted wheels nesting within the profile of the frame of the bunker.
Figure 9:
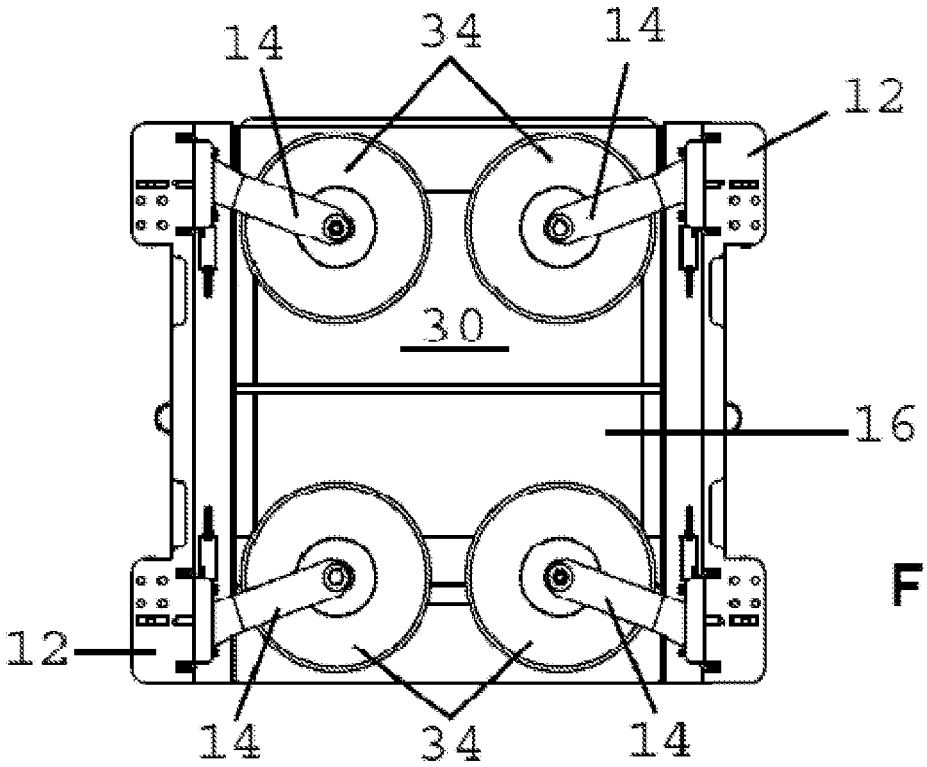
FIG. 9 is a bottom view of the fully-collapsed mobile ballistic bunker.

The frame 12 may be partially disassembled and is also hinged to be collapsible for storage. The vision panel 18 may be removed (see FIG. 2) by releasing brackets 24. Thereafter, hinges 26 permit the middle panel 28 to rotate at hinges 26 (see FIG. 4) and the lowermost panel 30 pivots about a pivot axle 31 to a horizontal disposition. After the frame 12 is fully collapsed, the vision panel 18 may be nested on the folded-down panels 16 for storage (see FIGS. 5 and 6).

In some embodiments, the mobile ballistic bunker 10 includes a movement assembly 32 for supporting the frame 12. The movement assembly 32 may comprise caster-type wheels 14 with large run-flat tires 34 that permit the movement of the bunker 10 over rough terrain. In some embodiments, the wheels 14 rotate 360 degrees and can be locked into an orientation for front to rear or lateral motion.

Additionally, an apron 36 of ballistic material may be connected to the lowermost panel 30 to extend to the ground. This ballistic apron 36 will reduce the threat of "skip-rounds."

After being deployed, the mobile ballistic bunker 10 may be collapsed into a storage mode for storage and easy transport. The vision panel 18 is removed from the side channels 22 of the frame 12. With the other panels 16 still positioned between the side channels 22, spring-lock pins 38 are released from each side of the frame 12 permitting the vertical panels 16 to be rotated about the pivot axle 31 to a horizontal disposition. Also, the spring-lock pins 38 can be re-engaged to secure the panels 16 in the storage mode, enabling the ballistic bunker to be stored in a horizontal or a vertical disposition, as desired, when in the storage mode. Slide brackets 40 along each side of the frame 12 are moved to permit the ballistic panels 16 to hinge where they overlap so that the wall 20 formed by the panels 16 can be folded in half (see FIG. 4). Each slide bracket 40 can be released by pushing a spring-loaded detent button (not shown) to depress and disengage the detent button from secured engagement with an aperture in the slide bracket 40. Once released, the slide bracket 40 can slide away from the hinged joint to allow the panels 16 to pivot about hinges 26. The vision panel 18 can then be nested on top of the folded panels 16 and secured for storage. A Velcro strap (not shown) can be used to secure the vision panel 18 in its nested disposition. It has also been contemplated that, in an alternative embodiment, the vision panel 18 could optionally have hinges.

In some embodiments, handles 42 are provided at various locations to assist with folding, transport, and maneuverability of the ballistic bunker 10. For example, in one embodiment, the middle panel 28 may have a handle 42 to assist with maneuverability of the bunker 10 without exposing the personnel's hands to gunfire (see FIGS. 16C and 16D). One or more of the handles 42 can also serve as a dead-rest for a weapon trained on target by personnel when the ballistic bunker 10 is fully deployed. Optionally, a strap (not shown) located on the rear of the bunker 10 may be used to secure a surplus shield or the like to the bunker 10.

In a preferred embodiment, the movement assembly 32 has retractable wheels 14 that can retract to nest within the frame 12 for storage. FIGS. 6-9 show the retractable wheels 14 retracted to nest within the profile of the frame 12 so that the storage mode for the ballistic bunker 10 of this invention has a low-footprint. This low-footprint storage mode, enables the ballistic bunker 10 to be stored easily horizontally within the trunk of a car or an SUV or vertically within an APC for transport to a location where needed.

Figure 10:
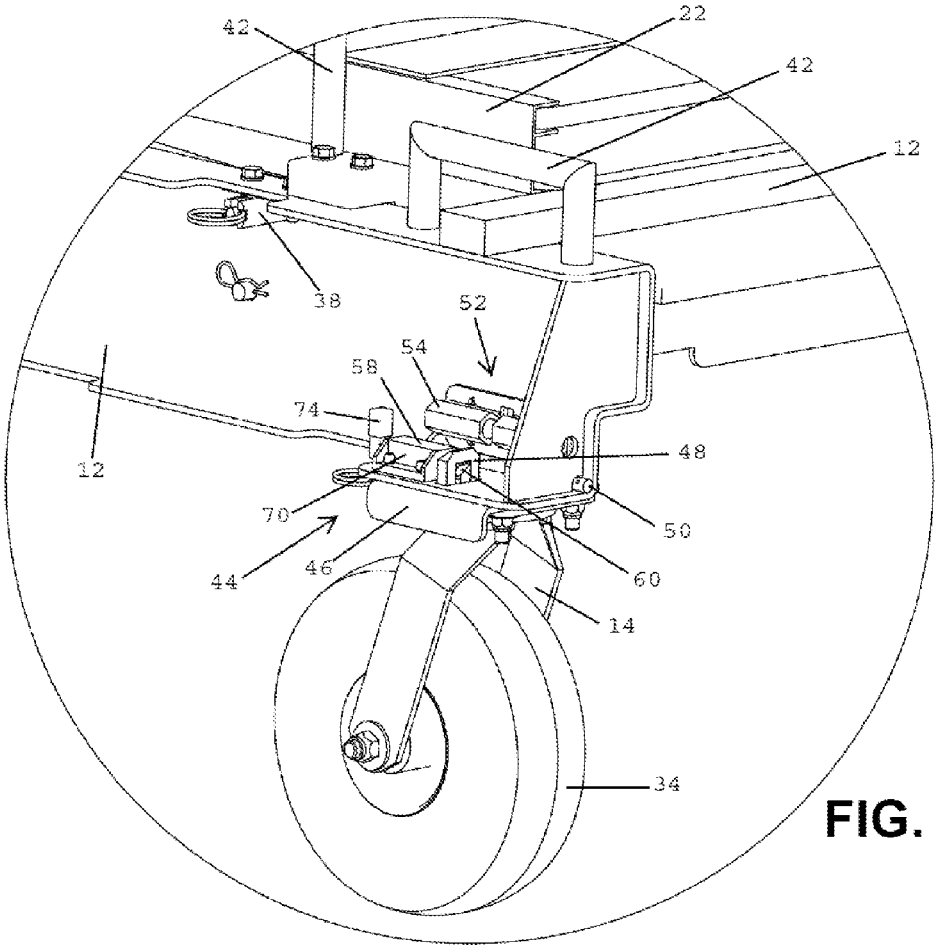
FIG. 10 is an enlarged cut-away perspective view of the outside of one of the retractable wheels in the fully-deployed position.
Figure 11:
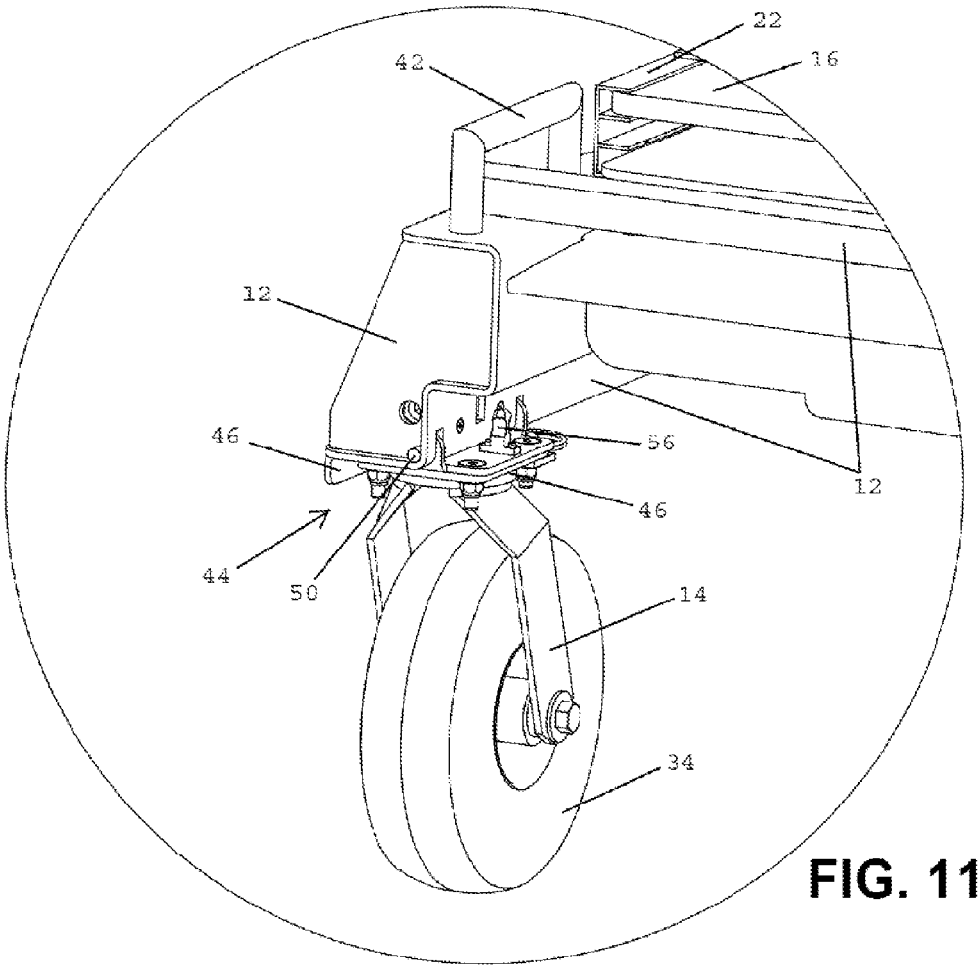
FIG. 11 is an enlarged cut-away perspective view of the inside of the retractable wheel of FIG. 10.

As best shown in FIGS. 10-13, a retraction mechanism 44 for a preferred type of retractable wheels 14 comprises a pivot plate 46 with a capture loop 48, a pivot pin 50, a latch assembly 52 comprising a ball-spring latch 54 and a latch strike 56, and a spring-loaded slide bolt 58. FIG. 10 shows a caster-type wheel 14 extended to its fully-deployed, ready-for-use mode. In this mode, the pivot plate 46 has been rotated about the pivot pin 50 so that it abuts with the underside of frame 12 and the bolt 60 of the spring-loaded slide bolt 58 engages the capture loop 48 in a locking engagement to inhibit rotation of the pivot plate 46. FIG. 11 shows the caster-type wheel 14 viewing the inside of the frame 12 and showing that the latch strike 56 is disengaged from the ball-spring latch 54 when the wheel 14 is extended to its fully-deployed, ready-for-use mode. Although this embodiment shows a caster-type wheel 14, a latch assembly 52, and a spring-loaded slide bolt 58, it should be understood that this invention contemplates that other types of wheels and other retraction mechanisms may be used so long as the wheels are retractable for storage and extendable to deploy the ballistic bunker 10 so it can be rolled over terrain.

Figure 12:
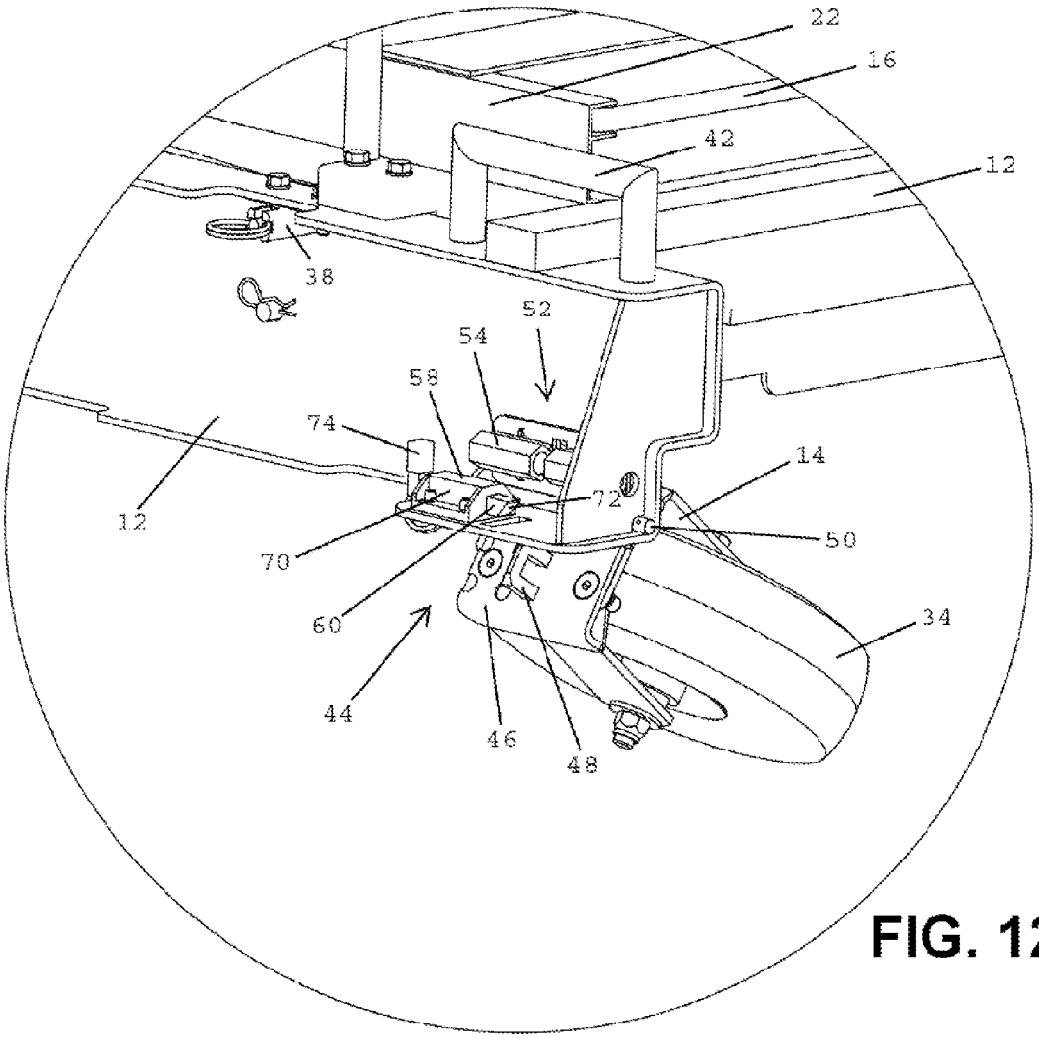
FIG. 12 is an enlarged cut-away perspective view of the outside of the retractable wheel of FIG. 10 moved to a partially-retracted position.
Figure 13:
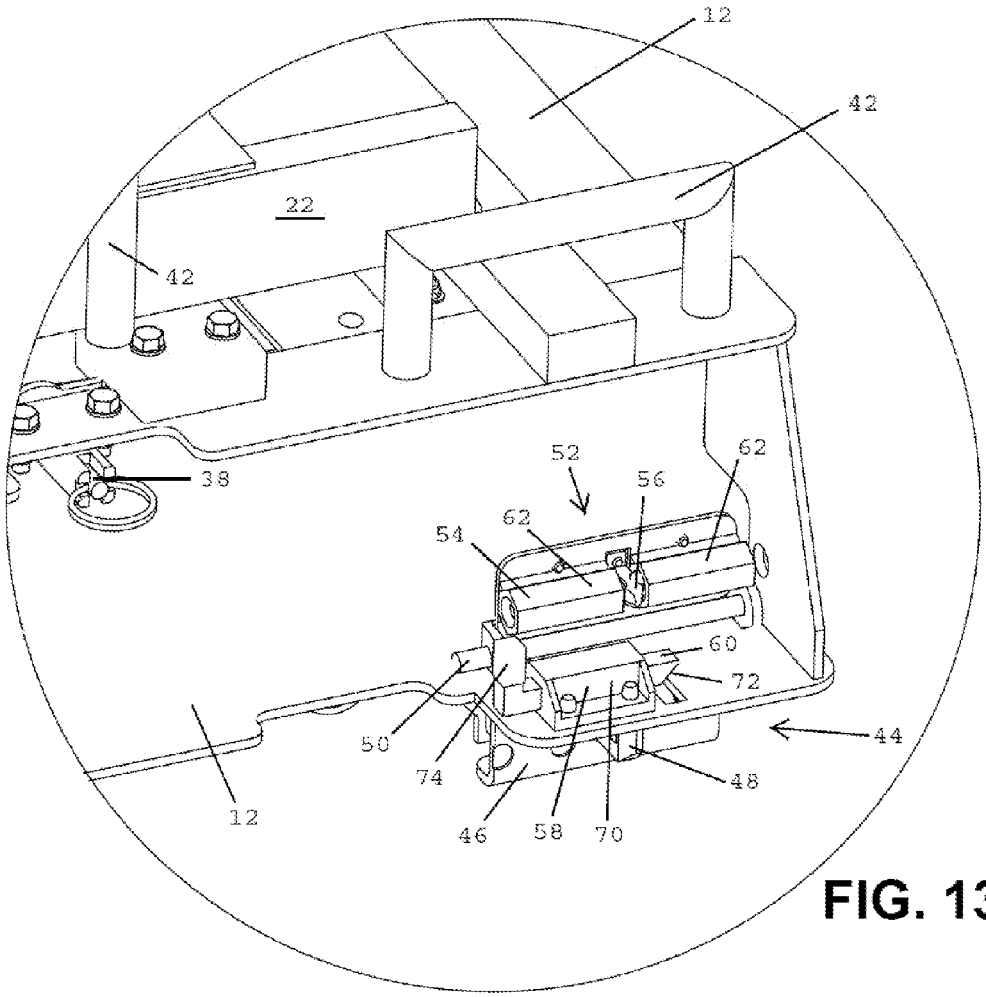
FIG. 13 is an enlarged cut-away perspective view of the outside of the frame with the retractable wheel of FIG. 10 fully-retracted into its nesting storage position.

FIG. 12 shows the capture loop 48 disengaged from the bolt 60 of the spring-loaded slide bolt 58 so that the pivot plate 46 can pivot about the pivot pin 50 thereby retracting the wheel 14 toward its nesting, storage position. When the wheel 14 is fully retracted, as shown in FIG. 13, the latch strike 56 protrudes through the frame 12 into engagement with the ball-spring latch 54. The engagement of the latch strike 56 with the ball-spring latch 54 hold the wheel in its fully-retracted, storage mode.

The ball-spring latch 54 of the preferred embodiment is shown in an exploded perspective view in FIG. 14A. The ball-spring latch 54 has adjustable tension and comprises opposing coupling nuts 62, ball bearings 64 disposed within the coupling nuts 62, springs 66 to bias the ball bearings 64 against each other, and set screws 68 to adjustably set the tension of the springs 66 and the ball bearings 64 against each other. The coupling nuts 62 are spaced apart less than the diameter of a ball bearing 64 but sufficiently apart to allow the latch strike 56 (shown best in FIG. 14B) to engage and push aside the ball bearings 64 and move into position so that the ball bearings 64 capture the latch strike 56 and secure wheel 14 in its fully-retracted, storage mode. To deploy the wheel 14 and release the latch strike 56 from the ball-spring latch 54, personnel need only apply sufficient pulling force to the retracted wheel 14 to overcome the tension of the latch assembly 52.

FIG. 15 shows an exemplary spring-loaded slide bolt 58 having a housing 70, a spring (not shown) within the housing 70, and bolt 60 having an inclined strike 72 and an actuation arm 74. When deploying the wheel 14, personnel need only rotate the wheel 14 (together with the pivot plate 46 and capture loop 48) with sufficient force to cause the bolt 60 to retract when the capture loop 48 engages the inclined strike 72. Once the capture loop 48 clears the inclined strike 72, the spring will cause the bolt 60 to protrude through the hollow of the capture loop 48 and capture the wheel 14 in its fully-deployed, ready-for-use mode. To release the wheel 14 for retraction into the storage mode, personnel need only pull back on the actuation arm 74 to retract the bolt 60 and release its engagement of the capture loop 48.

In an alternative embodiment, the mobile ballistic bunker 10 includes a movement assembly 32 for supporting the frame 12 that does not have wheel-retraction capability. The movement assembly 32 may comprise caster-type wheels 14 with large run-flat tires 34 that permit the movement of the ballistic bunker 10 over rough terrain, or it may have any other suitable type of wheel, runner, or rubber track system.

Figure 16A:
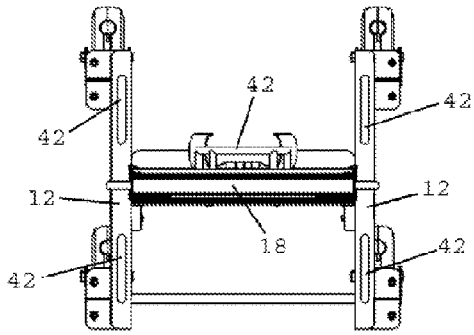
FIGS. 16A-16C is a series of views of the fully-assembled mobile ballistic bunker of an alternative embodiment without retractable wheels.
Figure 16B:
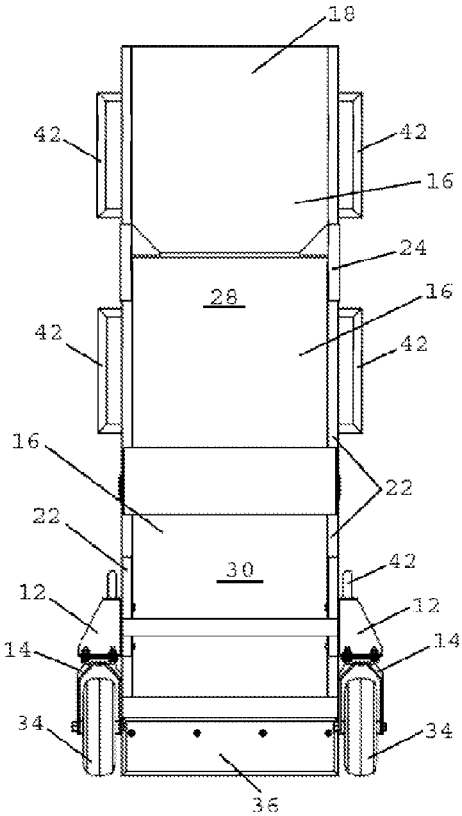
Figure 16C:
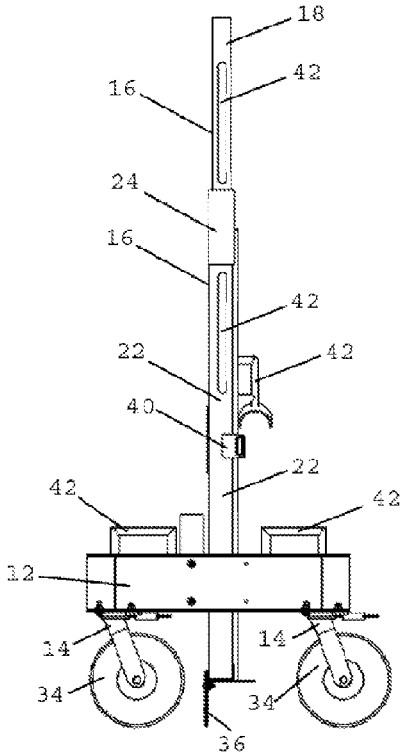
Figure 17A:
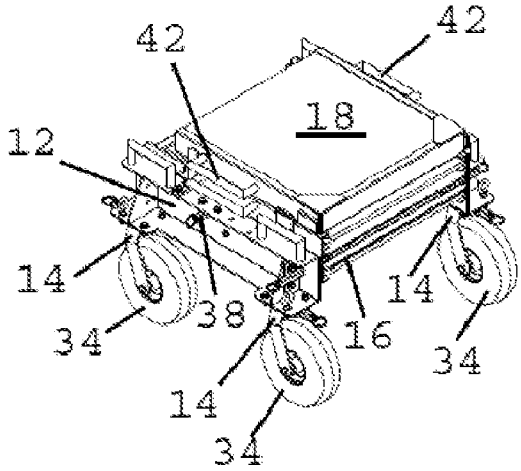
FIGS. 17A-17C is a series of views of the alternative embodiment mobile ballistic bunker of FIGS. 16A-16C in its collapsed state ready for storage.
Figure 17B:
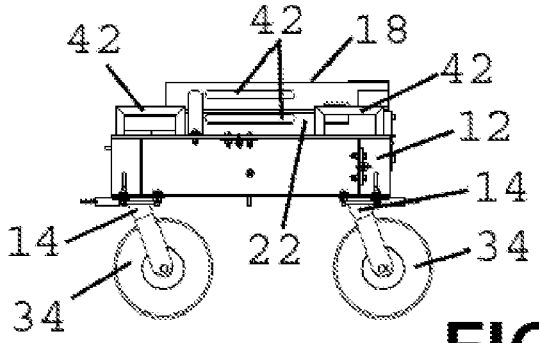
Figure 17C:
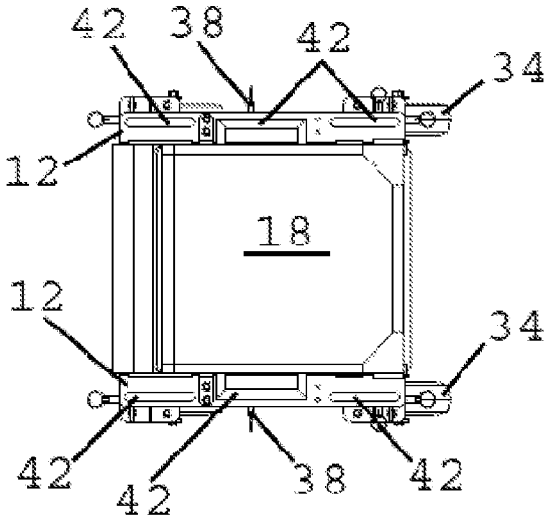

FIGS. 16A through 16C show a ballistic bunker 10 without wheel-retraction capability in various configurations and with other options to what has been described above. FIG. 16A shows a top view of the alternative embodiment. In this view and in FIG. 16C (a side view), an optional handle 42 on the middle panel 28 is shown. FIG. 16B shows a front view of the fully-deployed alternative embodiment with the apron 36 of ballistic material connected to the lowermost panel 30 to extend to the ground.

Once deployed, the mobile ballistic bunker 10 of this alternative embodiment also may be collapsed into a storage mode for storage and easy transport. The vision panel 18 is removed from the side channels 22 of the frame 12. With the other panels 16 still positioned between the side channels 22, spring-lock pins 38 are released from each side of the frame 12 permitting the vertical panels 16 to be rotated to a horizontal disposition. Slide brackets 40 along each side of the frame 12 are moved to permit the ballistic panels 16 to hinge where they overlap so that the wall 20 formed by the panels 16 can be folded in half. The vision panel 18 can then be nested on top of the folded side channels 22 and secured for storage. A Velcro strap (not shown) can be used to secure the vision panel 18 in its nested disposition. It has also been contemplated with this alternative embodiment that the vision panel 18 could optionally have hinges.

Although this alternative embodiment does not have a vertical storage profile as small as the retractable-wheel embodiments, this alternative embodiment may be less expensive to manufacture and more cost effective for some law enforcement, security, or military units to acquire and use.

Those skilled in the art will appreciate that the present embodiments are only exemplary. The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A mobile ballistic bunker comprising:

a frame supported by a movement assembly, the frame having side channels; a plurality of ballistic panels, at least one of the ballistic panels being a vision panel, the side channels being capable of receiving the ballistic panels, adjacent ballistic panels overlap to maintain ballistic integrity at a joint between adjacent ballistic panels;

a hinge disposed between an adjacent pair of the ballistic panels, the hinge and a pivot axle permit the adjacent pair of ballistic panels to rotate between a vertical disposition and a horizontal disposition;

a plurality of wheels;

a pivot plate and a pivot pin, at least one of the plurality of wheels being coupled to the pivot plate, the pivot plate being pivotably movable about the pivot pin between a fully-deployed position and a fully-retracted position.

2. The ballistic bunker of claim 1 wherein the plurality of wheels are retractable and extendable between a fully-deployed position and a fully-retracted position.

3. The ballistic bunker of claim 2 wherein the frame has a height profile when the ballistic panels are rotated into the horizontal disposition and when one of the plurality of wheels is in the fully-retracted position such wheel nests within the height profile of the frame.

4. The ballistic bunker of claim 1 wherein the movement assembly further comprises a latch assembly that releasably secures the pivot plate in the fully-retracted position.

5. The ballistic bunker of claim 4 wherein the latch assembly comprises a tension-adjustable latch and a latch strike.

6. The ballistic bunker of claim 1 wherein the movement assembly further comprises a spring-loaded slide bolt that releasably secures the pivot plate in the fully-deployed position.

7. The ballistic bunker of claim 1 further comprising a ballistic apron that extends from the lowermost ballistic panel to the ground upon which the ballistic bunker rests when fully deployed.

8. The ballistic bunker of claim 1 wherein the vision panel is removable from the frame of the ballistic bunker.

9. The ballistic bunker of claim 1 wherein the vision panel comprises a ballistic glass.

10. The ballistic bunker of claim 1 wherein individual panels of the plurality of ballistic panels have various ballistic ratings and the individual panels are interchangeable to change the overall ballistic rating of the ballistic bunker.

11. A mobile ballistic bunker capable of folding into a storage mode and unfolding into a fully-deployed mode comprising:

a frame supported by a movement assembly, the frame having side channels;

a plurality of ballistic panels, the side channels being capable of receiving the ballistic panels, adjacent ballistic panels define a joint between adjacent ballistic panels and adjacent ballistic panels overlap to maintain ballistic integrity at the joint between adjacent ballistic panels;

a hinge disposed between an adjacent pair of the ballistic panels, the hinge and a pivot axle permit the adjacent pair of ballistic panels to rotate between a vertical disposition in the fully-deployed mode and a horizontal disposition in the storage mode;

a slide bracket disposed about one or more of the side panels proximate the joint, the slide bracket being slidably movable between a position at the joint to inhibit the hinge rotation and a position spaced from the joint to allow the hinge rotation.

12. The ballistic bunker of claim 11 further comprising a spring-lock pin for securing the lowermost ballistic panel in vertical disposition, the disengagement of the spring-lock pin allows the lowermost ballistic panel to rotate about the pivot axle into a horizontal disposition.

13. The ballistic bunker of claim 11 wherein the plurality of ballistic panels comprises a removable vision panel.

14. The ballistic bunker of claim 11 wherein the movement assembly comprises a plurality of wheels and the plurality of wheels are retractable and extendable between a fully-deployed position and a fully-refracted position.

15. The ballistic bunker of claim 14 wherein the ballistic bunker is in its storage mode when the plurality of wheels is in the fully-retracted position and the plurality of ballistic panels is in the horizontal disposition.

16. The ballistic bunker of claim 14 wherein the ballistic bunker is in its fully-deployed mode when the plurality of wheels is in the fully-deployed position and the plurality of ballistic panels is in the vertical disposition.

17. A method for converting a mobile, ballistic bunker from a fully-deployed mode to a storage mode having a low-footprint for storage and transport, comprising the steps of:

removing a vision panel from a frame of the ballistic bunker;

disengaging a slide bracket to enable movement of the slide bracket from a position inhibiting hinged movement of adjacent ballistic panels to a position allowing such hinged movement;

rotating one of the adjacent ballistic panels about a hinge;

releasing a spring-pin to permit the rotation of the ballistic panels about a pivot axle from a vertical disposition to a horizontal disposition;

nesting the vision panel onto the horizontally disposed ballistic panels;

releasing a spring-loaded slide bolt to permit the pivoting movement of a wheel from a fully-deployed position into a fully-retracted position; and securing the wheel in its fully-retracted position.

* * * * *